US007183357B2

(12) United States Patent
Higuchi et al.

(10) Patent No.: US 7,183,357 B2
(45) Date of Patent: Feb. 27, 2007

(54) GOLF BALL

(75) Inventors: Hiroshi Higuchi, Chichibu (JP); Nobuyuki Kataoka, Chichibu (JP); Atsushi Nanba, Chichibu (JP); Hiroyuki Nagasawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 186 days.

(21) Appl. No.: 10/886,043

(22) Filed: Jul. 8, 2004

(65) Prior Publication Data

US 2005/0009641 A1 Jan. 13, 2005

(30) Foreign Application Priority Data

Jul. 10, 2003 (JP) ..... 2003-195153

(51) Int. Cl.
*A63B 37/00* (2006.01)
*A63B 37/06* (2006.01)

(52) U.S. Cl. ..... 525/261; 525/264; 525/265; 525/274; 473/371; 473/372; 473/377

(58) Field of Classification Search ..... None
See application file for complete search history.

(56) References Cited

U.S. PATENT DOCUMENTS

| | | | | |
|---|---|---|---|---|
| 4,683,257 | A | 7/1987 | Kakiuchi et al. | |
| 4,692,497 | A | 9/1987 | Gendreau et al. | |
| 4,770,422 | A | 9/1988 | Isaac | |
| 4,929,678 | A | 5/1990 | Hamada et al. | |
| 4,955,613 | A | 9/1990 | Gendreau et al. | |
| 5,082,285 | A | 1/1992 | Hamada et al. | |
| 5,252,652 | A * | 10/1993 | Egashira et al. | 524/392 |
| 6,194,505 | B1 | 2/2001 | Sone et al. | |
| 2003/0158340 | A1* | 8/2003 | Iwami | 525/184 |
| 2005/0245657 | A1* | 11/2005 | Bulpett et al. | 524/418 |

FOREIGN PATENT DOCUMENTS

| | | | |
|---|---|---|---|
| EP | 1068883 | * | 1/2001 |
| JP | 58-225138 | A | 12/1983 |
| JP | 61-71070 | A | 4/1986 |
| JP | 62-89750 | A | 2/1987 |
| JP | 62-112574 | A | 5/1987 |
| JP | 63-275356 | A | 11/1988 |
| JP | 02-268778 | A | 11/1990 |
| JP | 03-151985 | A | 6/1991 |
| JP | 07-268132 | A | 10/1995 |
| JP | 11-035633 | A | 2/1999 |
| JP | 11-070187 | A | 3/1999 |
| JP | 11-164912 | A | 6/1999 |
| JP | 11-319148 | A | 11/1999 |
| JP | 2001-149505 | A | 6/2001 |
| JP | 2001-149506 | A | 6/2001 |
| JP | 2001-149507 | A | 6/2001 |
| JP | 2002-293996 | A | 10/2002 |

OTHER PUBLICATIONS

Mark R. Mason et al.; "Hydrolysis of Tri-*tert*-butylaluminum: The First Structural Characterization of Alkylalumoxanes $[(R_2Al)_2O]_n$ and $(RAlO)_n$"; J. Am. Chem. Soc. 1993, 115; pp. 4971-4984.

C. Jeff Harlan et al.; "Three-Coordinate Aluminum Is Not A Prerequisite for Catalytic Activity in the Zirconocene-Alumoxane Polymerization of Ethylene"; J. Am. Chem. Soc. 1995, 117, pp. 6465-6474.

Report of Research & Development; Fine Chemical; vol. 23; No. 9; Jun. 1, 1994; pp. 5-15.

* cited by examiner

*Primary Examiner*—David J. Buttner
(74) *Attorney, Agent, or Firm*—Sughrue Mion, PLLC

(57) ABSTRACT

A golf ball has a core obtained by molding and vulcanizing a rubber composition comprising (A) a base rubber which includes a polybutadiene having a cis-1,4 content of at least 60 wt %, (B) an unsaturated carboxylic acid and/or metal salt thereof, (C) an inorganic filler and (D) at least one organic peroxide selected from among 1,1-bis(t-hexylperoxy)cyclohexane, 1,1-bis(t-hexylperoxy)-3,3,5-trimethylcyclohexane, and 2,2-bis(4,4-di-t-butylperoxycyclohexyl)propane. The golf ball has excellent rebound characteristics and flight performance as well as a high productivity due to a reduced vulcanization time.

11 Claims, No Drawings

GOLF BALL

TECHNICAL FIELD

This invention relates to gold balls having good rebound, flight performance and a high productivity due to an improvement in a rubber composition of which the solid core is typically made.

BACKGROUND ART

The polybutadiene formulations used as the base rubber in golf balls have hitherto been modified and improved in various ways to confer the golf balls with outstanding rebound characteristics.

For example, JP-A 62-89750 discloses rubber compositions for solid golf balls which are obtained by formulating as the base rubber a polybutadiene having a Mooney viscosity of 70 to 100 and synthesized using a nickel or cobalt catalyst, in combination with either a polybutadiene having a Mooney viscosity of 30 to 90 and synthesized using a lanthanide series catalyst or a polybutadiene having a Mooney viscosity of 20 to 50 and synthesized using a nickel or cobalt catalyst.

JP-A 2-268778 describes golf balls obtained by compounding a polybutadiene having a Mooney viscosity of less than 50 and synthesized using a Group VIII catalyst with a polybutadiene having a Mooney viscosity of less than 50 and synthesized using a lanthanide catalyst.

In addition, JP-A 11-70187 discloses multi-piece solid golf balls in which the mantle is made of a polybutadiene having a low Mooney viscosity. JP-A 11-319148 teaches solid golf balls obtained using a rubber composition formulated from a polybutadiene having a Mooney viscosity of 50 to 69 and synthesized using a nickel or cobalt catalyst in combination with a polybutadiene having a Mooney viscosity of 20 to 90 and synthesized using a lanthanide series catalyst. JP-A 11-164912 describes solid golf balls obtained using a rubber composition having a 1,2-vinyl unit content of not more than 2.0% and having a ratio Mw/Mn of the weight-average molecular weight to the number-average molecular weight of not more than 3.5. JP-A 63-275356 discloses golf balls made with a rubber composition formulated using a high Mooney viscosity polybutadiene. JP-A 3-151985 describes golf balls made with a rubber composition formulated using a polybutadiene having a high number-average molecular weight in combination with a polybutadiene having a low number-average molecular weight.

However, the golf balls in all of these prior-art disclosures have inadequate rebound characteristics.

For the crosslinking of rubber component, JP-A 61-71070 mentions the use of two types of organic peroxides and JP-A 62-112574 mentions the use of a small amount of organic peroxide. Yet, the golf balls using crosslinked rubber products obtained in both of these disclosures have inadequate rebound characteristics. Moreover, crosslinking takes a long time, leading to a lowering of productivity.

JP-A 58-225138, JP-A 2001-149505, JP-A 2001-149506 and JP-A 2001-149507 disclose rubber compositions, which still have inadequate rebound characteristics.

SUMMARY OF THE INVENTION

An object of the present invention is to provide golf balls which have excellent rebound, good flight performance, and a high productivity due to a reduced vulcanization time.

We have found that golf balls with good rebound characteristics can be obtained in high production yields when a constituent component of the golf ball is a molded and vulcanized product of a rubber composition comprising (A) a base rubber which includes a polybutadiene having a cis-1,4 content of at least 60 wt %, (B) an unsaturated carboxylic acid or a metal salt thereof, (C) an inorganic filler and (D) a specific organic peroxide. This is especially true when the rubber composition is used to form the solid core of the solid golf ball.

The present invention provides a golf ball comprising a molded and vulcanized product of a rubber composition as a constituent component, the rubber composition comprising (A) a base rubber which includes a polybutadiene having a cis-1,4 content of at least 60 wt %, (B) an unsaturated carboxylic acid or an unsaturated carboxylic acid metal salt or both, (C) an inorganic filler and (D) at least one organic peroxide selected from the group consisting of 1,1-bis(t-hexylperoxy)cyclohexane, 1,1-bis(t-hexylperoxy)-3,3,5-trimethylcyclohexane, and 2,2-bis(4,4-di-t-butylperoxycyclohexyl)propane.

In a preferred embodiment, the rubber composition includes 100 parts by weight of component (A), 10 to 60 parts by weight of component (B), 5 to 80 parts by weight of component (C), and 0.05 to 3 parts by weight of component (D), and optionally, (E) 0.1 to 3 parts by weight of a dialkyl peroxide and (F) 0.1 to 8 parts by weight of an organosulfur compound.

In another preferred embodiment, component (A) includes at least 50 wt % of the polybutadiene having a cis-1,4 content of at least 60 wt %. More preferably the polybutadiene having a cis-1,4 content of at least 60 wt % is synthesized using a rare-earth base catalyst. In a further embodiment, the polybutadiene having a cis-1,4 content of at least 60 wt % is a modified polybutadiene rubber synthesized using a neodymium base catalyst, followed by reaction with a terminal modifier.

On assay of the molded and vulcanized product of rubber composition, 2-methyl-2-pentanol, ϵ-caprolactone, 3,3,5-trimethylcyclohexanone or a combination of any is detectable as decomposition products of the peroxides.

DESCRIPTION OF THE PREFERRED EMBODIMENT

The golf ball of the invention has as a constituent component a molded and vulcanized product of a rubber composition comprising (A) a base rubber which includes a polybutadiene having a cis-1,4 content of at least 60 wt %, (B) an unsaturated carboxylic acid and/or a metal salt thereof, (C) an inorganic filler, and (D) at least one organic peroxide selected from the group consisting of 1,1-bis(t-hexylperoxy)cyclohexane, 1,1-bis(t-hexylperoxy)-3,3,5-trimethylcyclohexane, and 2,2-bis(4,4-di-t-butylperoxycyclohexyl)propane.

The polybutadiene in component (A) should have a cis-1,4 unit content of at least 60 wt %, preferably at least 80 wt %, more preferably at least 90 wt %, and most preferably at least 95 wt % in its polymer chain. Too low a cis-1,4 unit content fails to achieve the object of the invention because the rebound of the resulting ball declines. The polybutadiene typically has a 1,2-vinyl content of at most 2%, preferably at most 1.7%, more preferably at most 1.5%. Too high a 1,2-vinyl content may adversely affect the rebound.

From the standpoint of obtaining a rubber composition having good resilience and extrusion working efficiency, it is desirable for the polybutadiene to have a Mooney viscosity ($ML_{1+4}$ (100° C.)) of at least 30, preferably at least 40, more preferably at least 50, and most preferably at least 52, but not more than 140, preferably not more than 120, more preferably not more than 100, and most preferably not more than 80. The term "Mooney viscosity" used herein refers to an industrial index of viscosity (see JIS K6300) as measured with a Mooney viscometer, which is a type of rotary plastometer. This value is represented by the symbol $ML_{1+4}$ (100° C.), wherein "M" stands for Mooney viscosity, "L" stands for large rotor (L-type), and "1+4" stands for a pre-heating time of 1 minute and a rotor rotation time of 4 minutes. The "100° C." indicates that measurement was carried out at a temperature of 100° C.

From the standpoint of obtaining a rubber composition having good resilience in the molded and vulcanized state, it is desirable that the polybutadiene has been synthesized using a rare-earth catalyst or Group III metal compound catalyst. Polybutadienes synthesized using rare-earth catalysts are preferred.

Examples of suitable rare-earth catalysts include lanthanide series rare-earth compounds, in combination with organoaluminum compounds, alumoxane, halogen-bearing compounds, and optionally Lewis bases.

Examples of suitable lanthanide series rare-earth compounds include halides, carboxylates, alcoholates, thioalcoholates and amides of atomic number 57 to 71 metals.

Organoaluminum compounds that may be used include those of the formula $AlR^1R^2R^3$ (wherein $R^1$, $R^2$ and $R^3$ are each independently a hydrogen or a $C_1$–$C_8$ hydrocarbon residue).

Preferred alumoxanes include compounds of the structures shown in formulas (I) and (II) below. The alumoxane association complexes described in *Fine Chemical* 23, No. 9, 5 (1994), *J. Am. Chem. Soc.* 115, 4971 (1993), and *J. Am. Chem. Soc.* 117, 6465 (1995) are also acceptable.

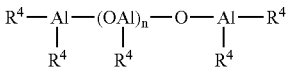

(I)

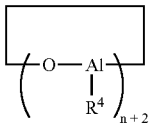

(II)

In the above formulas, $R^4$ is a $C_1$–$C_{20}$ hydrocarbon group, and n is an integer of 2 or more.

Examples of halogen-bearing compounds that may be used include aluminum halides of the formula $AlX_nR_{3-n}$ (wherein X is a halogen; R is a $C_1$–$C_{20}$ hydrocarbon residue, such as an alkyl, aryl or aralkyl; and n is 1, 1.5, 2 or 3); strontium halides such as $Me_3SrCl$, $Me_2SrCl_2$, $MeSrHCl_2$ and $MeSrCl_3$ (wherein "Me" stands for methyl); and other metal halides such as silicon tetrachloride, tin tetrachloride and titanium tetrachloride.

Any Lewis base which forms a complex with the lanthanide series rare-earth compound may be used. Illustrative examples include acetylacetone and ketone alcohols.

In the practice of the invention, the use of a neodymium catalyst comprising a neodymium compound as the lanthanide series rare-earth compound is advantageous because it enables a polybutadiene rubber having a high cis-1,4 content and a low 1,2-vinyl content to be produced at an excellent polymerization activity. Preferred examples of such rare-earth catalysts include those mentioned in JP-A 11-35633.

To achieve a polybutadiene having a cis unit content within the above range and a polydispersity index Mw/Mn within the subsequently described range, the polymerization of butadiene in the presence of a rare-earth catalyst containing a lanthanide series rare-earth compound is carried out at a butadiene/(lanthanide series rare-earth compound) molar ratio of preferably from 1,000 to 2,000,000, and especially from 5,000 to 1,000,000, and at an $AlR^1R^2R^3$/(lanthanide series rare-earth compound) molar ratio of from 1 to 1,000, and especially from 3 to 500. It is also preferable for the (halogen compound)/(lanthanide series rare-earth compound) molar ratio to be from 0.1 to 30, and especially from 0.2 to 15, and for the (Lewis base)/(lanthanide series rare-earth compound) molar ratio to be from 0 to 30, and especially from 1 to 10.

The polymerization of butadiene in the presence of a rare-earth catalyst may be carried out in a solvent or by bulk polymerization or vapor phase polymerization, without the use of solvent, and at a polymerization temperature in a range of generally −30° C. to +150° C., and preferably 10° C. to 100° C.

In a preferred embodiment of the invention, the polybutadiene in component (A) may be a modified polybutadiene obtained by polymerization of butadiene using the above-described rare-earth catalyst, followed by the reaction of a terminal modifier with active end groups on the polymer.

The modified polybutadiene rubber can be prepared by polymerization as described above, followed by the use of a terminal modifier selected from among types (i) to (vii) below.

(i) The modified polybutadiene rubber can be obtained by reacting an alkoxysilyl group-bearing compound with active end groups on the polymer. Preferred alkoxysilyl group-bearing compounds are alkoxysilane compounds having at least one epoxy group or isocyanate group on the molecule. Specific examples include epoxy group-bearing alkoxysilanes such as 3-glycidyloxypropyltrimethoxysilane, 3-glycidyloxypropyltriethoxysilane, (3-glycidyloxypropyl)methyldimethoxysilane, (3-glycidyloxypropyl)methyldiethoxysilane, β-(3,4-epoxycyclohexyl)trimethoxysilane, β-(3,4-epoxycyclohexyl)triethoxysilane, β-(3,4-epoxycyclohexyl)methyldimethoxysilane, β-(3,4-epoxycyclohexyl)ethyldimethoxysilane, condensation products of 3-glycidyloxypropyltrimethoxysilane and condensation products of (3-glycidyloxypropyl)methyldimethoxysilane; and isocyanate group-bearing alkoxysilane compounds such as 3-isocyanatopropyltrimethoxysilane, 3-isocyanatopropyltriethoxysilane, (3-isocyanatopropyl)methyldimethoxysilane, (3-isocyanatopropyl)methyldiethoxysilane, condensation products of 3-isocyanatopropyltrimethoxysilane and condensation products of (3-isocyanatopropyl)methyldimethoxysilane.

A Lewis acid can be added to accelerate the reaction when the above alkoxysilyl group-bearing compound is reacted with active end groups on the polymer. The Lewis acid acts as a catalyst to promote the coupling reaction, thus improving cold flow by the modified polymer and providing a better shelf stability. Examples of suitable Lewis acids include dialkyltin dialkyl maleates, dialkyltin dicarboxylates and aluminum trialkoxides.

Other types of terminal modifiers that may be used include:

(ii) halogenated organometallic compounds, halogenated metallic compounds and organometallic compounds of the general formulas $R^5_nM'X_{4-n}$, $M'X_4$, $M'X_3$, $R^5_nM'(—R^6—COOR^7)_{4-n}$ or $R^5_nM'(—R^6—COR^7)_{4-n}$ (wherein $R^5$ and $R^6$ are each independently a $C_1$–$C_{20}$ hydrocarbon group; $R^7$ is a $C_1$–$C_{20}$ hydrocarbon group which may contain pendant carbonyl or ester groups; M' is a tin, silicon, germanium or phosphorus atom; X is a halogen atom; and n is an integer from 0 to 3);

(iii) heterocumulene compounds having on the molecule a Y═C═Z linkage (wherein Y is a carbon, oxygen, nitrogen or sulfur atom; and Z is an oxygen, nitrogen or sulfur atom);

(iv) three-membered heterocyclic compounds containing on the molecule the following bonds

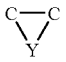

(wherein Y is an oxygen, nitrogen or sulfur atom);

(v) halogenated isocyano compounds;

(vi) carboxylic acids, acid halides, ester compounds, carbonate compounds and acid anhydrides of the formula $R^8—(COOH)_m$, $R^9(COX)_m$, $R^{10}—(COO—R^{11})_m$, $R^{12}—OCOO—R^{13}$, and $R^{14}—(COOCO—R^{15})_m$, and the formula:

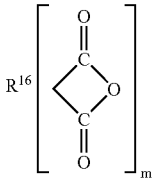

(wherein $R^8$ to $R^{16}$ are each independently a $C_1$–$C_{50}$ hydrocarbon group, X is a halogen atom, and m is an integer from 1 to 5); and (vii) carboxylic acid metal salts of the formula $R^{17}_lM''(OCOR^{18})_{4-1}$, $R^{19}_lM''(OCO—R^{20}—COOR^{21})_{4-1}$ or the formula:

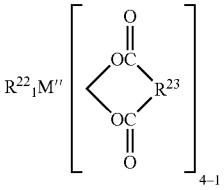

(wherein $R^{17}$ to $R^{23}$ are each independently a $C_1$–$C_{20}$ hydrocarbon group, M" is a tin, silicon or germanium atom, and 1 is an integer from 0 to 3).

The above terminal modifiers and methods for their reaction are described in, for example, JP-A 11-35633, JP-A 7-268132 and JP-A 2002-293996.

Group VIII catalysts that may be used herein include nickel catalysts and cobalt catalysts, for example.

Examples of suitable nickel catalysts include single-component systems such as nickel-kieselguhr, binary systems such as Raney nickel/titanium tetrachloride, and ternary systems such as nickel compound/organometallic compound/boron trifluoride etherate. Exemplary nickel compounds include reduced nickel on a carrier, Raney nickel, nickel oxide, nickel carboxylate and organonickel complex salts. Exemplary organometallic compounds include trialkylaluminum compounds such as triethylaluminum, tri-n-propylaluminum, triisobutylaluminum and tri-n-hexylaluminum; alkyllithium compounds such as n-butyllithium, sec-butyllithium, tert-butyllithium and 1,4-dilithiumbutane; and dialkylzinc compounds such as diethylzinc and dibutylzinc.

Examples of suitable cobalt catalysts include the following composed of cobalt or cobalt compounds: Raney cobalt, cobalt chloride, cobalt bromide, cobalt iodide, cobalt oxide, cobalt sulfate, cobalt carbonate, cobalt phosphate, cobalt phthalate, cobalt carbonyl, cobalt acetylacetonate, cobalt diethyldithiocarbamate, cobalt anilinium nitrite and cobalt dinitrosyl chloride. It is particularly advantageous to use these compounds in combination with, for example, a dialkylaluminum monochloride such as diethylaluminum monochloride or diisobutylaluminum monochloride; a trialkylaluminum such as triethylaluminum, tri-n-propylaluminum, triisobutylaluminum or tri-n-hexylaluminum; an alkylaluminum sesquichloride such as ethylaluminum sesquichloride; or aluminum chloride.

Polymerization using the group VIII catalysts, and especially a nickel or cobalt catalyst, can generally be carried out by a process in which the catalyst is continuously charged into the reactor together with a solvent and the butadiene monomer. The reaction conditions are suitably selected from a temperature range of 5 to 60° C. and a pressure range of atmospheric pressure to 70 plus atmospheres, so as to yield a product having the above-indicated Mooney viscosity.

It is advantageous for the polybutadiene used in the invention to have a polydispersity index Mw/Mn (where Mw is the weight-average molecular weight and Mn is the number-average molecular weight) of at least 2.0, preferably at least 2.2, more preferably at least 2.4, and most preferably at least 2.6, but not more than 6.0, preferably not more than 5.0, more preferably not more than 4.0, and most preferably not more than 3.4. Too low a polydispersity index Mw/Mn may cause difficult working whereas too high a Mw/Mn may lead to a lower resilience.

Used as component (A) is a base rubber including the above-specified polybutadiene. Preferably the base rubber includes the specific polybutadiene having a cis-1,4 content of at least 60 wt % as a major component, that is, in an amount of at least 50 wt % based on the weight of component (A). The content of polybutadiene having a cis-1,4 content of at least 60 wt % within the base rubber is typically at least 50 wt %, preferably at least 60 wt %, more preferably at least 70 wt %, even more preferably at least 80 wt %, and most preferably at least 85 wt %. The content of the specific polybutadiene in the base rubber may be as much as 100 wt %, although the specific polybutadiene content can be set to not more than 95 wt %, or in some cases to not more than 90 wt %. If the content of the specific polybutadiene having a cis-1,4 content of at least 60 wt % is less than 50 wt % of the base resin, the golf ball may have poor rebound properties.

In addition to the specific polybutadiene, the base rubber may include other rubber components. Useful additional rubber components are polybutadienes other than the specific polybutadiene, and other diene rubbers, some examples of which are styrene-butadiene rubber, natural rubber, isoprene rubber and ethylene-propylene-diene rubber.

Component (B) is an unsaturated carboxylic acid and/or a metal salt thereof. Examples of suitable unsaturated carboxylic acids include acrylic acid, methacrylic acid, maleic acid and fumaric acid. Acrylic acid and methacrylic acid are especially preferred. Examples of suitable unsaturated carboxylic acid metal salts include zinc salts and magnesium salts of the foregoing unsaturated carboxylic acids. Of these, zinc acrylate is especially preferred.

The amount of component (B) per 100 parts by weight (sometimes abbreviated hereinafter as "pbw") of the base rubber (A) is typically at least 10 pbw, preferably at least 13 pbw, more preferably at least 16 pbw, even more preferably at least 18 pbw, and most preferably at least 20 pbw, but typically not more than 60 pbw, preferably not more than 50 pbw, more preferably not more than 45 pbw, even more preferably not more than 40 pbw, and most preferably not more than 35 pbw. Too much amounts of component (B) relative to component (A) may result in too high hardness and an unacceptable feel on impact. Too less amounts of component (B) relative to component (A) may result in too soft compositions, inviting declines of flight performance and durability.

Component (C) is an inorganic filler. Illustrative examples of the inorganic filler include zinc oxide, barium sulfate and calcium carbonate, but are not limited thereto. The amount of component (C) per 100 pbw of component (A) is typically at least 5 pbw, preferably at least 7 pbw, more preferably at least 10 pbw, and most preferably at least 13 pbw, but typically not more than 80 pbw, preferably not more than 65 pbw, more preferably not more than 50 pbw, and most preferably not more than 40 pbw. The use of too much or too little component (C) may fail to achieve a golf ball having the proper weight and a desirable rebound.

Component (D) is at least one organic peroxide selected from among 1,1-bis(t-hexylperoxy)cyclohexane, 1,1-bis(t-hexylperoxy)-3,3,5-trimethylcyclohexane, and 2,2-bis(4,4-di-t-butylperoxycyclohexyl)propane. This organic peroxide is referred to as "specific organic peroxide," hereinafter.

As compared with conventional organic peroxides commonly used in golf ball-forming materials such as 1,1-bis(t-butylperoxy)-3,3,5-trimethylcyclohexane and 1,1-bis(t-butylperoxy)cyclohexane, the use of the specific organic peroxide is effective for improving resilience or restitution and reducing the vulcanization time for the rubber composition to be molded and vulcanized, eventually leading to the improved productivity of golf balls.

The amount of component (D) per 100 pbw of component (A) is typically at least 0.05 pbw, preferably at least 0.1 pbw, and more preferably at least 0.15 pbw, but typically not more than 3 pbw, preferably not more than 2 pbw, more preferably not more than 1 pbw, even more preferably not more than 0.8 pbw, and most preferably not more than 0.6 pbw. Too much component (D) may lower the rebound and durability of the ball. Too little component (D) may increase the time required for crosslinking, substantially lowering productivity during manufacture of the golf ball and also lowering compression by the ball.

The organic peroxide used in the inventive rubber composition may further include (E) a dialkyl peroxide, used in combination with the specific organic peroxide (D), because the rubber composition in molded and vulcanized form is further improved in resilience. Examples of dialkyl peroxide include, but are not limited to, dicumyl peroxide, $\alpha,\alpha'$-bis(t-butylperoxy)diisopropylbenzene and t-butyl cumyl peroxide, with dicumyl peroxide being especially preferred.

The amount of component (E) per 100 pbw of component (A) is typically at least 0.1 pbw, preferably at least 0.12 pbw, and more preferably at least 0.15 pbw, but typically not more than 3 pbw, preferably not more than 1.5 pbw, more preferably not more than 1 pbw, and most preferably not more than 0.6 pbw. Too much component (E) may lower the rebound and durability of the ball. Too little component (E) may increase the time required for crosslinking, substantially lowering productivity during manufacture of the golf ball and also lowering compression by the ball.

Commercially available products may be used as the organic peroxide for both components (D) and (E). Examples of component (D) are Perhexa HC, Perhexa TMH and Pertetra A (all available from NOF Corporation). Examples of component (E) are Percumyl D, Perbutyl P and Perbutyl C (all available from NOF Corporation).

For facilitating the processing of the rubber composition into a molded and vulcanized form, the organic peroxide is preferably diluted with a diluent such as an inert filler or base rubber. Suitable inert fillers include calcium carbonate, silicon dioxide, zinc oxide, titanium dioxide, and barium sulfate, with calcium carbonate and silicon dioxide being preferred. Suitable base rubbers include butadiene and EPDM.

When the organic peroxide (a) is diluted with the diluent (b), the mixing proportion, as expressed by a/(a+b), is typically at least 0.05, preferably at least 0.1, more preferably at least 0.15, even more preferably at least 0.2, and most preferably at least 0.3, but typically up to 0.7, preferably up to 0.6, more preferably up to 0.5, and even more preferably up to 0.45.

While the rubber composition of the invention comprises components (A) to (D) described above, it is also preferable to incorporate (F) an organosulfur compound for conferring a molded and vulcanized product of rubber composition with better resilience. Typical of the organosulfur compound (F) are thiophenol, thionaphthol, halogenated thiophenols, and metal salts thereof. Examples include pentachlorothiophenol, pentafluorothiophenol, pentabromothiophenol, p-chlorothiophenol, and the zinc salts thereof; diphenyl polysulfides, dibenzyl polysulfides, dibenzoyl polysulfides, dibenzothiazoyl polysulfides and dithiobenzoyl polysulfides having 2 to 4 sulfurs; alkylphenyldisulfides, furan ring-bearing sulfur compounds and thiophene ring-bearing sulfur compounds. Diphenyl disulfide and the zinc salt of pentachlorothiophenol are especially preferred.

The amount of component (F) per 100 pbw of component (A) is typically at least 0.1 pbw, preferably at least 0.2 pbw, more preferably at least 0.4 pbw, even more preferably at least 0.7 pbw, and most preferably at least 0.9 pbw, but typically not more than 8 pbw, preferably not more than 4 pbw, more preferably not more than 3 pbw, even more preferably not more than 2 pbw, and most preferably not more than 1.5 pbw. Too little component (F) may fail to provide a resilience-improving effect, whereas too much component (F) may result in an excessively low hardness and thus insufficient resilience.

If necessary, the rubber composition may also include an antioxidant. The antioxidant may be a commercially available product, such as Nocrac NS-6, Nocrac NS-30 (both made by Ouchi Shinko Chemical Industry Co., Ltd.), and Yoshinox 425 (made by Yoshitomi Pharmaceutical Industries, Ltd.). The amount of the antioxidant per 100 pbw of component (A) is typically at least 0.05 pbw, preferably at least 0.1 pbw, and more preferably at least 0.2 pbw, but typically not more than 3 pbw, preferably not more than 2 pbw, more preferably not more than 1 pbw, and most preferably not more than 0.5 pbw.

The molded and vulcanized product of the inventive rubber composition can be obtained by molding and vulcanizing the above-described rubber composition using a method of the same type as that used with known golf ball rubber compositions. For example, vulcanization may be carried out at a temperature of 100 to 200° C. for a period of 10 to 40 minutes.

In the practice of the invention, the molded and vulcanized product has a hardness which can be adjusted as appropriate for the intended use of the golf ball and is not subject to any particular limitation. That is, the molded and vulcanized product may have a cross-sectional hardness profile which is flat from the center to the surface of the product, or which varies from the center to the surface.

When the molded and vulcanized rubber composition is analyzed, 2-methyl-2-pentanol, ϵ-caprolactone, 3,3,5-trimethylcyclohexanone or a combination of any is detectable as the ingredient released from the rubber composition during vulcanization, that is, residual decomposition products of the organic peroxide(s) in the rubber composition. Analysis is by gas chromatography/mass spectrometry (GC/MS analysis), for example.

More particularly, in an embodiment wherein 1,1-bis(t-hexylperoxy)cyclohexane is used as the organic peroxide in the rubber composition, both 2-methyl-2-pentanol and ϵ-caprolactone are preferably detectable. In another embodiment wherein 1,1-bis(t-hexylperoxy)-3,3,5-trimethylcyclohexane is used as the organic peroxide in the rubber composition, both 2-methyl-2-pentanol and 3,3,5-trimethylcyclohexanone are preferably detectable. It is understood that where dicumyl peroxide is used as the organic peroxide, three compounds, α-methylstyrene (2-phenylpropene), acetophenone (phenyl methyl ketone) and α-cumyl alcohol (2-phenyl-2-propanol) are detectable. Where 1,1-bis(t-butylperoxy)-3,3,5-trimethylcyclohexane is used, two compounds, t-butyl alcohol (2-methyl-2-propanol) and 3,3,5-trimethylcyclohexanone are detectable. Where 1,1-bis(t-butylperoxy) cyclohexanone is used, two compounds, t-butyl alcohol (2-methyl-2-propanol) and ϵ-caprolactone are detectable.

The golf balls of the invention include various types of golf balls. Particularly when the golf ball of the invention is a one-piece solid golf ball or a golf ball having a solid core or a solid center, it is recommended that the one-piece golf ball, solid core or solid center have a deflection amount under an applied load of 980 N (100 kg) of typically at least 2.0 mm, preferably 2.5 mm, more preferably at least 2.8 mm, and most preferably at least 3.2 mm, but up to 6.0 mm, preferably up to 5.5 mm, more preferably up to 5.0 mm, and most preferably up to 4.5 mm. Too small a deflection amount may worsen the feel of the ball upon impact and, particularly on long shots such as with a driver in which the ball incurs a large deformation, may subject the ball to an excessive rise in spin, reducing the carry. On the other hand, if the deflection amount is too large, the golf ball tends to have a dead feel when hit, an inadequate rebound that results in a short carry, and a poor durability to cracking with repeated impact.

The golf ball of the invention includes as a constituent component the above-described molded and vulcanized product, but the construction of the ball is not subject to any particular limitation. Examples of suitable golf ball constructions include one-piece golf balls in which the molded and vulcanized product itself is used directly as the golf ball, two-piece solid golf balls wherein the molded and vulcanized product serves as a solid core on the surface of which a cover is formed, multi-piece solid golf balls made of three or more pieces in which the molded and vulcanized product serves as a solid core over which a cover composed of two or more layers is formed, and thread-wound golf balls in which the molded and vulcanized product serves as the center core. In order to take advantage of the characteristics of the molded and vulcanized product to facilitate the extrusion during ball manufacture and impart rebound to the completed golf ball, the invention is preferably embodied as two-piece solid golf balls and multi-piece solid golf balls in which the molded and vulcanized product serves as the solid core.

In the practice of the invention, when the molded and vulcanized product is used as a solid core in the manner described above, it is recommended that the solid core have a diameter of at least 30.0 mm, preferably at least 32.0 mm, more preferably at least 35.0 mm, and most preferably at least 37.0 mm, but not more than 41.0 mm, preferably not more than 40.5 mm, even more preferably not more than 40.0 mm, and most preferably not more than 39.5 mm. In particular, it is desirable for such a solid core in a two-piece solid golf ball to have a diameter of at least 37.0 mm, preferably at least 37.5 mm, even more preferably at least 38.0 mm, and most preferably at least 38.5 mm, but not more than 41.0 mm, preferably not more than 40.5 mm, and most preferably not more than 40.0 mm. Similarly, it is desirable for such a solid core in a three-piece solid golf ball to have a diameter of at least 30.0 mm, preferably at least 32.0 mm, more preferably at least 34.0 mm, and most preferably at least 35.0 mm, but not more than 40.0 mm, preferably not more than 39.5 mm, and most preferably not more than 39.0 mm.

It is also recommended that the solid core have a specific gravity of at least 0.9, preferably at least 1.0, and most preferably at least 1.1, but not more than 1.4, preferably not more than 1.3, and most preferably not more than 1.2.

When the golf ball of the invention is a two-piece solid golf ball or a multi-piece solid golf ball, one preferred manufacture process is by molding and vulcanizing the rubber composition into a solid core, placing the core within the cavity of an injection mold, and injecting a well-known cover material in the case of two-piece solid golf ball or sequentially injecting a well-known intermediate layer material and cover material in the case of multi-piece solid golf ball, both in a well-known manner. In some cases, the cover may be prepared by compression molding of the cover material.

The known cover and/or intermediate layer materials may be primarily composed of, for example, a thermoplastic or thermosetting polyurethane elastomer, polyester elastomer, ionomer resin, polyolefin elastomer or mixture thereof. Any one or mixture of two or more thereof may be used, although the use of a thermoplastic polyurethane elastomer or ionomer resin is especially preferred.

Illustrative examples of thermoplastic polyurethane elastomers that may be used for the above purpose include commercial products in which the diisocyanate is an aliphatic or aromatic compound, such as Pandex T7298, Pandex T7295, Pandex T7890, Pandex TR3080, Pandex T8295, Pandex T8290 and Pandex T8260 (all manufactured by DIC Bayer Polymer, Ltd.). Illustrative examples of suitable commercial ionomer resins include Surlyn 6320 and Surlyn 8120 (both products of E.I. du Pont de Nemours and Co., Inc.), and Himilan 1706, Himilan 1605, Himilan 1855, Himilan 1601 and Himilan 1557 (all products of DuPont-Mitsui Polychemicals Co., Ltd.).

Together with the primary ingredient described above, the cover material may include also, as optional ingredients, polymers (e.g., thermoplastic elastomers) other than the foregoing. Specific examples of polymers that may be included as optional ingredients include polyamide elastomers, styrene block elastomers, hydrogenated polybutadienes and ethylene-vinyl acetate (EVA) copolymers.

It is recommended that the intermediate layer in a multi-piece solid golf ball have a thickness of at least 0.5 mm, and preferably at least 1.0 mm, but not more than 3.0 mm, preferably not more than 2.5 mm, more preferably not more than 2.0 mm, and most preferably not more than 1.6 mm.

Moreover, in both two-piece and multi-piece solid golf balls, it is recommended that the cover have a thickness of at least 0.7 mm and preferably at least 1.0 mm, but not more than 3.0 mm, preferably not more than 2.5 mm, more preferably not more than 2.0 mm, and most preferably not more than 1.6 mm.

The golf ball of the invention can be manufactured for competitive use by imparting the ball with a diameter and weight which conform with the Rules of Golf; that is, a diameter of at least 42.67 mm and a weight of not more than 45.93 g. It is recommended that the diameter be no more than 44.0 mm, preferably no more than 43.5 mm, and most preferably no more than 43.0 mm; and that the weight be at least 44.5 g, preferably at least 45.0 g, more preferably at least 45.1 g, and most preferably at least 45.2 g.

The golf balls of the invention have excellent rebound characteristics and flight performance as well as a high productivity due to a reduced vulcanization time.

EXAMPLE

The following examples and comparative examples are provided to illustrate the invention, and are not intended to limit the scope thereof.

Examples 1–3 and Comparative Examples 1–2

Cores were formed using rubber compositions of the formulation shown in Table 1. The cores had an outer diameter of 38.9 mm and a weight of 36.0 g. Around the cores, a cover material which was a mixture of Himilan 1601 and Himilan 1557 (both DuPont-Mitsui Polychemicals Co., Ltd.) in a weight ratio of 1:1 was injected to form a cover layer provided with dimples. The cover surface was coated with a paint, completing two-piece solid golf balls having an outer diameter of 42.7 mm and a weight of 45.3 g.

Various physical properties of the cores and the balls were evaluated by the methods described below, with the results shown in Table 1.

TABLE 1

| | | | Example | | | | | | Comparative Example | |
|---|---|---|---|---|---|---|---|---|---|---|
| | | | 1 | 2 | 3 | 4 | 5 | 6 | 1 | 2 |
| Core formulation (pbw) | Polybutadiene | BR01 | | | | | 100 | 40 | | |
| | | BR730 | 100 | 100 | 100 | 100 | | 60 | 100 | 100 |
| | Organic peroxide | Perhexa HC | 0.12 | | | 0.6 | 0.24 | 0.24 | | |
| | | Perhexa TMH | | 0.12 | | | | | | |
| | | Pertetra A (20% grade) | | | 0.6 | | | | | |
| | | Perhexa 3M | | | | | | | 0.12 | |
| | | Perhexa C | | | | | | | | 0.12 |
| | | Percumyl D | 0.3 | 0.3 | 0.3 | 0 | 0.6 | 0.6 | 0.3 | 0.3 |
| | Zinc oxide | | 20.3 | 20.3 | 20.3 | 20.3 | 19.5 | 19.5 | 20.3 | 20.3 |
| | Antioxidant | | 0.1 | 0.1 | 0.1 | 0.1 | 0.1 | 0.1 | 0.1 | 0.1 |
| | Zinc acrylate | | 26 | 26 | 26 | 26 | 28 | 27 | 26 | 26 |
| | Zinc salt of pentachlorothiophenol | | 1 | 1 | 1 | 1 | 1 | 1 | 1 | 1 |
| Properties | Core | Deflection under 100 kg load (mm) | 3.9 | 3.9 | 4.1 | 4.1 | 3.9 | 4.0 | 4.1 | 4.2 |
| | | Rebound (m/s) | 0.6 | 0.6 | 0.3 | 0.4 | 0.2 | 0.3 | 0 | 0 |
| | | Vulcanization time (min) | −2.0 | −1.5 | −0.5 | −4.0 | −1.0 | −1.0 | 0.0 | −0.5 |
| | Golf ball | Carry (m) | 218.6 | 218.4 | 215.7 | 216.6 | 214.8 | 215.5 | 212.5 | 212.4 |
| | | Total (m) | 234.8 | 234.7 | 231.7 | 232.7 | 230.7 | 231.6 | 228.7 | 228.8 |

BR01: JSR Corporation. polybutadiene synthesized using Ni catalyst. cis-1,4 unit content 96 wt %, 1,2-vinyl content 2.5 wt %, Mooney viscosity ($ML_{1+4}$ (100° C.)) 46, polydispersity index (Mw/Mn) 4.2

BR730: JSR Corporation. polybutadiene synthesized using Nd catalyst. cis-1,4 unit content 96 wt %, 1,2-vinyl content 1.3 wt %, Mooney viscosity ($ML_{1+4}$ (100° C.)) 55, polydispersity index (Mw/Mn) 3

Perhexa HC: NOF Corporation, 1,1-bis(t-hexylperoxy)cyclohexane

Perhexa TMH: NOF Corporation, 1,1-bis(t-hexylperoxy)-3,3,5-trimethylcyclohexane

Pertetra A: NOF Corporation, 2,2-bis(4,4-di-t-butylperoxycyclohexyl)propane (diluted with aromatic hydrocarbon, purity 20% grade)

Perhexa 3M: NOF Corporation, 1,1-bis(t-butylperoxy)-3,3,5-trimethylcyclohexane

Perhexa C: NOF Corporation, 1,1-bis(t-butylperoxy)cyclohexane

Percumyl D: NOF Corporation, dicumyl peroxide

Antioxidant: Ouchi Shinko Chemical Industry Co., Ltd., Nocrac NS-6

Deflection Under 100 kg Load

Measured as the deflection amount (mm) of the solid core when subjected to a load of 100 kg (980 N)

Rebound

The initial velocity of the solid cores was measured with the same type of initial velocity instrument as used by the United States Golf Association (USGA). The rebound value reported is the difference between the initial velocity of the solid core obtained in that particular example and the initial velocity of the solid core obtained in Comparative Example 1.

Vulcanization Time

A time taken when the core was vulcanized and cured was measured. The vulcanization time reported is the difference from the vulcanization time of Comparative Example 1.

Carry and Total

The carry (m) and total distance (m) were measured when the ball was hit at a head speed of 45 m/s (HS45) with a driver (W#1, Tour Stage X500, loft 9°, shaft X by Bridgestone Sports Co., Ltd.) mounted on a swing machine.

GC/MS analysis was made on the cores of Examples 1, 2, 4, 5, 6 and Comparative Examples 1, 2, detecting decomposition products of organic peroxides in the rubber composition as shown in Table 2. The conditions of GC/MS analysis are described below.

TABLE 2

| | Detected decomposition products of organic peroxides |
|---|---|
| Example 1, 5, 6 | 2-methyl-2-pentanol, ϵ-caprolactone, α-methylstyrene, acetophenone, α-cumyl alcohol |
| Example 4 | 2-methyl-2-pentanol, ϵ-caprolactone |
| Example 2 | 2-methyl-2-pentanol, 3,3,5-trimethylcyclohexanone, α-methylstyrene, acetophenone, α-cumyl alcohol |
| Comparative Example 1 | t-butyl alcohol, 3,3,5-trimethylcyclohexanone, α-methylstyrene, acetophenone, α-cumyl alcohol |
| Comparative Example 2 | t-butyl alcohol, ϵ-caprolactone, α-methylstyrene, acetophenone, α-cumyl alcohol |

GC/MS Analysis Conditions

[Instrument]

GC/MS system

Hewlett Packard (now Agilent Technologies), GC/MS: 6890/5973 system

Pyrolyzer

Frontier Lab, Double Shot Pyrolyzer PY-2020D

[Conditions]

PY section:

Desorption temp.: 50° C.–50° C./min–300° C.

GC section:

Column: Agilent HP-5ms

Column temp.: 30° C.–20° C./min–300° C.

Injection temp.: 320° C.

Carrier gas: He 1 ml/min

Split ratio: 1/100

MS section:

Aux temp.: 280° C.

Ion Source temp.: 150° C.

Ionization energy: eV

Mass range: m/z 29–800

Scanning interval: 1 sec

[Measuring procedure]

(1) heat and desorption treatment of a sample in pyrolyzer section (2) introduction of volatile into GC section (and trapping with liquefied nitrogen)

(3) separation of components in GC section (4) sequential mass analysis of separated components in MS section (5) identification of components by data base retrieval of the resulting pyrogram peaks Japanese Patent Application No. 2003-195153 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball, comprising a molded and vulcanized product of a rubber composition comprising (A) a base rubber which includes a polybutadiene having a cis-1,4 content of at least 60 wt%, (B) an unsaturated carboxylic acid or an unsaturated carboxylic acid metal salt or both, (C) an inorganic filler and (D) at least one organic peroxide selected from the group consisting of 1,1-bis(t-hexylperoxy)-3,3,5-trimethylcyclohexane and 2,2-bis(4,4-di-t-butylperoxycyclohexyl)propane.

2. The golf ball of claim 1, wherein said rubber composition includes 100 parts by weight of component (A), 10 to 60 parts by weight of component (B), 5 to 80 parts by weight of component (C), and 0.05 to 3 parts by weight of component (D), and component (A) includes at least 50 wt% of the polybutadiene having a cis-1,4 content of at least 60 wt%.

3. The golf ball of claim 2, wherein said rubber composition further includes (E) 0.1 to 3 parts by weight of a dialkyl peroxide per 100 parts by weight of component (A).

4. The golf ball of claim 2, wherein said rubber composition further includes (F) 0.1 to 8 parts by weight of an organosulfur compound per 100 parts by weight of component (A).

5. The golf ball of claim 1, wherein the polybutadiene having a cis-1,4 content of at least 60 wt% is synthesized using a rare-earth base catalyst.

6. The golf ball of claim 1, wherein the polybutadiene having a cis-1,4 content of at least 60 wt% is a modified polybutadiene rubber synthesized using a neodymium base catalyst, followed by reaction with a terminal modifier.

7. The golf ball of claim 1, wherein 2-methyl-2-pentanol, ϵ-caprolactone, 3,3,5-trimethylcyclohexanone or a combination thereof is detectable from the molded and vulcanized product of rubber composition.

8. The golf ball of claim 1, wherein (i) said golf ball is a one-piece solid golf ball comprising said molded and vulcanized product or (ii) said golf ball comprises a solid core or a solid center and said solid core or said solid center comprises said molded and vulcanized product, and said one-piece solid golf ball, said solid core or said solid center has a deflection amount under an applied load of 980 N (100 kg) of at least 2.0 mm and up to 6.0 mm.

9. The golf ball of claim 8, wherein said one-piece solid golf ball, said solid core or said solid center has a deflection amount under an applied load of 980 N (100 kg) of at least 2.5 mm and up to 5.5 mm.

10. The golf ball of claim 1, wherein the amount of component (D) is 0.05 to 0.8 part by weight per 100 parts by weight of component (A).

11. The golf ball of claim 10, wherein the amount of component (D) is 0.05 to 0.6 part by weight per 100 parts by weight of component (A).

* * * * *